US005192256A

United States Patent [19]

Ryan

[11] Patent Number: 5,192,256

[45] Date of Patent: Mar. 9, 1993

[54] SWIM EXERCISE OR TRAINING APPARATUS

[76] Inventor: William T. Ryan, 248 Northridge Dr., Landisville, Pa. 17538

[21] Appl. No.: 876,116

[22] Filed: Apr. 29, 1992

Related U.S. Application Data

[63] Continuation of Ser. No. 644,324, Jan. 22, 1991, abandoned.

[51] Int. Cl.[5] ..... A63B 23/00

[52] U.S. Cl. ..... 482/55

[58] Field of Search ..... 482/55, 56, 129, 130; 434/254; 119/29, 96, 101, 109; 441/106, 129

[56] References Cited

U.S. PATENT DOCUMENTS

| | | | |
|---|---|---|---|
| 3,445,941 | 5/1969 | Eaves et al. | 434/254 |
| 4,527,795 | 7/1985 | Zink | 434/254 |
| 4,551,108 | 11/1985 | Bass | 272/71 |
| 4,947,801 | 8/1990 | Glass | 119/96 X |

*Primary Examiner*—Richard J. Apley
*Assistant Examiner*—Glenn E. Richman

[57] ABSTRACT

An exercise or training apparatus employing a tether line having spaced fasteners on or adjacent its ends adapted to conveniently fasten the line across a swimming pool or other body of water to cooperating anchor devices in or adjacent to the pool, one or more coupling elements mounted on the line, and a harness integral with or adapted for attachment to the coupling elements and adapted for mounting on a swimmers body, the coupling elements providing for selective positioning of one or more swimmers along the line.

7 Claims, 1 Drawing Sheet

SWIM EXERCISE OR TRAINING APPARATUS

This application is a continuation of Ser. No. 07/644,324, filed Jan. 22, 1991, now abandoned.

This invention concerns an exercise of work-out apparatus for swimmers, which also can serve as a training device for beginners, and particularly concerns such apparatus which utilizes a tether mechanism of extremely simple construction and operation, and having multi-user capacity.

The prior art relating to swim exercise or training apparatus using tether devices is quite highly developed and features a number of sophisticated harness mechanisms as disclosed in U.S. Pat. Nos.: 4,247,096; 3,988,020; 3,512,416; 4,095,657; 4,519,783; 4,527,795; 4,530,497; 4,551,108; and 2,434,543, the disclosures of which are incorporated herein by reference. For all of these prior art contrivances their structural complexity, cost of manufacture, inconvenient pool side mounting structures, and involved methods of use dictate against significant actual utility, not to mention their fixed, single user application. This latter aspect is highly significant in that where such prior devices require complex mounting or supporting structure and where generally they require permanent mounting means located in the pool-side structure itself, the utility limitation of one user at a time renders these devices at least somewhat impractical.

Objects therefore, of the present invention are: to provide a simple, easy to manufacture and maintain, low cost and easy to use swim exercise of work-out apparatus which can be used singly or to simultaneously accommodate a number of users in a safe and convenient manner and which allows a user to connect to or disconnect from the apparatus in a rapid manner; and to provide such apparatus with mounting means which requires no modification of conventional pool-side structure.

These and other objects thereinafter becoming evident have been attained in accordance with the present invention which is defined in its broad sense as an exercise apparatus for swimmers comprising a tether line having spaced fastener means thereon adapted to conveniently fasten the line across a swimming pool to cooperating anchor means in or adjacent to the pool, one or more coupling means mounted on said line, and harness means integral with or adapted for attachment to said coupling means and adapted for mounting on a swimmers body, said coupling means providing for selective positioning of one or more swimmers along said line. In certain preferred embodiments:

(a) the coupling means comprises a ring through which the line passes and which is slidable along at least a portion of the line;

(b) the harness means is provided with quick-release buckle means;

(c) the fastener means comprises snap-hook means;

(d) the harness means comprises waist belt means having quick-release buckle means;

(e) the coupling means comprises quick-release snap-hook means; and (f) one or more stop means is provided on the line and adapted to abut the coupling means to limit the travel thereof along the line.

The invention will be understood further from the following description and drawings wherein.

Figure 1:
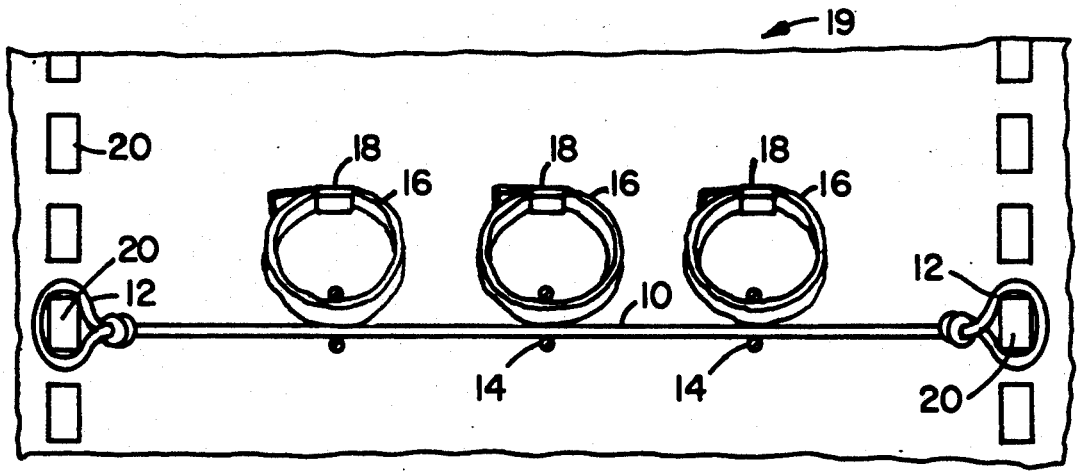
FIG. 1 is a top, elevational view of the present apparatus substantially in operating position stretched across a pool.
Figure 2:
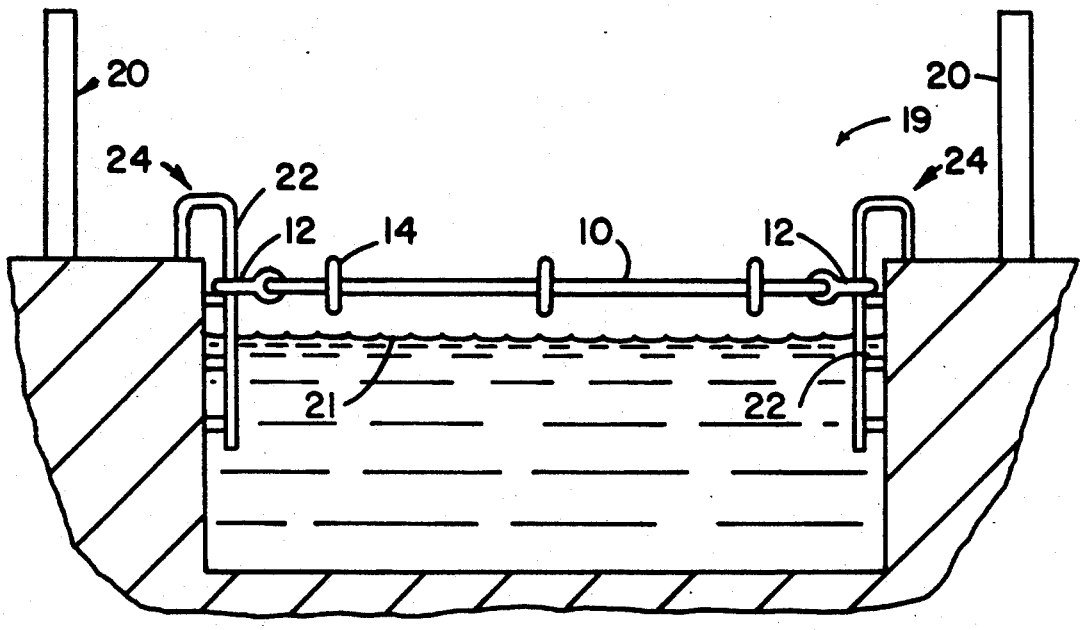
FIG. 2 is a cross-sectional view of a pool as in FIG. 1 depicting the present apparatus substantially in operating position affixed to pool ladders.

Referring to the drawings, the present apparatus comprises a tether line 10 such as a rope of any material, e.g., Nylon, polyolefin or natural fiber, fastener means 12 on the line such as loops, snap-hooks, or any such connection device, preferably quick attachment and release types, at least one coupling means 14 affixed to or slidably mounted on the line, and harness means 16 either integral with the coupling means 14 or releasably affixed thereto and preferably provided with quick release buckle means 18.

The tether line is adapted to be stretched across or loosely draped across a pool 19 or other body of water including small lakes, rivers, streams or the like such that its height above the water 21 can be regulated by the tension on the line. The line is adapted for attachment to any anchor means 20 such as a hook, eye, fence board, tree, shrub or the like located exteriorly to the pool, or to any shoulder means on the pool such as the rungs or handle bars 22 of ladders 24 located on the sides of the pool. Where the use of mechanical fastener means such as snap-fasteners or the like is inconvenient, the line may simply be tied, e.g., as shown in FIG. 1 to the fence boards 20 or pool ladders thus providing the fastener-anchor means combination.

Figure 5:
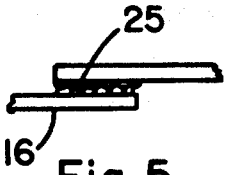
FIG. 5 is a side view of typical Velcro fastener segments of the harness belt, useful in the present invention.

The particular construction of the harness means employed can be widely varied and includes, quick release mechanisms of the auto seat belt type as shown in U.S. Pat. Nos. 3,483,599 and 3,533,141, the disclosures of which are incorporated herein by reference. The harness belt is mounted through the coupling means as shown in the drawings, and may be of such structure as shown in the aforementioned U.S. patents, especially in U.S. Pat. No. 4,247,096. Velcro connecting segments 25 may be used on the adjacent-overlapping-sections of the harness as shown in FIG. 5 to provide the quick-release feature.

Figure 3:
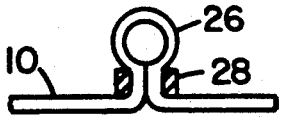
FIG. 3 is an elevational view of a loop formed in the tether line and serving as the coupling means.
Figure 4:
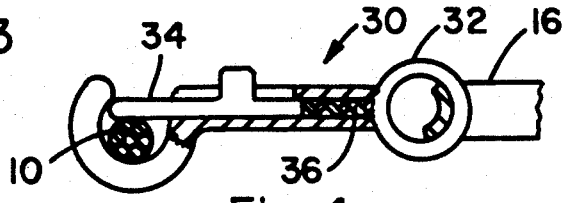
FIG. 4 is a partially sectional view of a snap-fastener useful in the present invention.

As shown in FIG. 3, the coupling means 14 comprises a loop 26 formed in the line 10 and maintained by a crimped metal or plastic sleeve 28. Several of such loops may be provided on the line to allow positioning of several users along the line, such as beginner swimmers during a lesson period. This positioning of the user along the line may also be accomplished by providing shoulder means such as knots (not shown) or their equivalent in the line between the coupling means for rings 14 to limit the slide travel of the rings on the line. A typical snap-fastener 30 is shown in FIG. 4 for connecting the harness 16 to line 10 by inserting the open belt through the eye 32 of the fastener and snapping the spring 36 urged fastener bolt 34 over the line. This type of fastener can also be used to affix the line to the anchor means.

This invention has been described in detail with particular reference to preferred embodiments thereof, but it will be understood that variations and modifications will be effected within the spirit and scope of the invention.

I claim:

1. A swimmers exercise apparatus kit comprising a user tether means having a pool attachment mechanism means on each end of said tether line, for attachment to opposite ends of a pool, said tether means being continuous and unbroken and having one or more coupling means slidably mounted by ring means on said tether means for movement along the tether line thereof; harness means integrally connected to the coupling means, said harness means for mounting on a swimmer's body, said coupling means providing for selective positioning of one or more swimmers along said line and allowing freedom of a swimmer's arm and leg motion and orientation of the swimmer's body in a direction generally perpendicular to said line and generally within the plane of the surface of water in said pool.

2. The apparatus of claim 1 wherein said coupling means comprises a ring through which said line passes and which is slidable along at least a portion of said line.

3. The apparatus of claim 2 wherein said harness means is provided with quick-release buckle means.

4. The apparatus of claim 3 wherein said pool attachment mechanism means comprises snap-fastener means.

5. The apparatus of claim 1 wherein said harness means comprises waist belt means having quick-release buckle means.

6. The apparatus of claim 1 wherein said coupling means comprises quick-release snap-fastener means.

7. The apparatus of claim 1 wherein one or more stop means is provided on said line and adapted to abut said coupling means to limit the travel thereof along said line.

* * * * *